US006449772B1

(12) United States Patent
Donner

(10) Patent No.: US 6,449,772 B1
(45) Date of Patent: Sep. 17, 2002

(54) WRIST COVER

(76) Inventor: Jolene M. Donner, P.O. Box 821, Hartington, NE (US) 68739

( * ) Notice: Subject to any disclaimer, the term of this patent is extended or adjusted under 35 U.S.C. 154(b) by 115 days.

(21) Appl. No.: 09/198,637

(22) Filed: Nov. 24, 1998

Related U.S. Application Data

(60) Provisional application No. 60/066,443, filed on Nov. 24, 1997.

(51) Int. Cl.[7] ..... A41D 19/00

(52) U.S. Cl. ..... 2/170; 2/16; 2/162; 2/59

(58) Field of Search ..... 2/16, 59, 125–126, 2/163, 170, 161.6, 159, 162, 311; 29/896.411; 63/3; 128/878; 602/21

(56) References Cited

U.S. PATENT DOCUMENTS

| | | | | | |
|---|---|---|---|---|---|
| 3,416,518 | A | * | 12/1968 | Samuels et al. | 2/170 |
| 3,648,291 | A | * | 3/1972 | Pankers | 2/16 |
| D300,984 | S | * | 5/1989 | Carter et al. | D2/611 |
| 4,967,419 | A | * | 11/1990 | Elliott | 2/16 |
| 5,402,536 | A | * | 4/1995 | Matthews | 2/16 |
| 5,542,121 | A | * | 8/1996 | Lahaussois et al. | 2/59 |
| 5,628,062 | A | * | 5/1997 | Tseng | 2/16 |
| 5,827,207 | A | * | 10/1998 | MacMorran | 602/5 |
| 5,864,886 | A | * | 2/1999 | Gregory et al. | 2/170 |
| 5,878,435 | A | * | 3/1999 | Kast et al. | 2/16 |

FOREIGN PATENT DOCUMENTS

| | | | | |
|---|---|---|---|---|
| GB | 2245477 | * | 8/1992 | 2/16 |
| GB | 2266224 | * | 10/1993 | 2/16 |
| GB | 1492944 | * | 11/1997 | 2/16 |

* cited by examiner

*Primary Examiner*—Peter Nerbun
*Assistant Examiner*—Katherine Moran
(74) *Attorney, Agent, or Firm*—Thomte, Mazour & Niebergall; Dennis L. Thomte

(57) ABSTRACT

The wrist cover disclosed herein includes a generally cylindrical tubular member formed of fabric, fleece, etc., having forward and rearward ends. The forward and rearward ends of the tubular member are elasticized to seal the ends to the arm and hand of the wearer. An aperture is formed in the side wall of the tubular member, adjacent the forward end, to permit the wearer's thumb to project outwardly from the tubular member. Elastic bands encircling the aperture form a seal around the thumb, when in use.

6 Claims, 2 Drawing Sheets

WRIST COVER

CROSS-REFERENCE TO RELATED APPLICATION

Applicant filed a provisional application entitled WRIST COVER which was accorded Serial No. 60/066,443 and a filing date of Nov. 24,1997.

BACKGROUND OF THE INVENTION

1. Field of the Invention

This invention relates to a wrist cover and more particularly to a tubular-shaped wrist cover which may be slipped over the hand of a person for covering the upper portion of the person's hand, the person's wrist and the lower portion of the person's sleeve to prevent snow or the like from coming into contact with the person's hand, wrist and lower arm.

2. Description of the Related Art

When a person is working or playing in snowy conditions, snow comes into contact with the person's exposed wrist and frequently moves upwardly into the lower sleeve area of the person's jacket or sweater. Many attempts have been made to solve the problem, such as extremely long gloves or the like, but when the gloves are removed, the person's hand is exposed to the cold air or snow.

SUMMARY OF THE INVENTION

The wrist cover of the present invention includes a generally cylindrical tubular member formed of fabric such as nylon, fleece, etc., having rearward and forward ends. The forward and rearward ends of the tubular member have an elastic band associated therewith which serves to seal the ends to the hand of the wearer. An aperture in the side wall of the tubular member, adjacent the forward end, permits the user's thumb to project outwardly from the tubular member. An elastic band encircles the aperture to form a seal around the thumb, when in use. A wrist cover is worn on each arm, with the rearward end of the tubular member sealed against the sleeve of a coat or sweater, and the forward end of the tubular member sealed against the glove on the wearer's hand. The tubular wrist cover thereby prevents snow from blowing or moving up the wearer's coat sleeve at the juncture of the glove with the coat sleeve.

It is therefore a principal object of the invention to provide an improved wrist cover.

Still another object of the invention is to provide a tubular wrist cover which prevents snow from blowing or moving up the wearer's coat sleeve at the juncture of the wearer's glove with the coat sleeve.

Still another object of the invention is to provide a wrist cover which may be conveniently folded or rolled for storage when not in use.

Still another object of the invention is to provide a wrist cover which enables the wearer's fingers and thumb to extend therefrom so that movement of the fingers and thumb is not restricted.

Yet another object of the invention is to provide a wrist cover wherein the thumb of the wearer protrudes outwardly through an aperture formed in the side thereof with the engagement of the wrist cover with the thumb preventing the wrist cover from pulling upwardly to expose the wearer's wrist.

Still another object of the invention is to provide a wrist cover which is economical of manufacture, durable in use and refined in appearance.

These and other objects will be obvious to those skilled in the art.

DESCRIPTION OF THE PREFERRED EMBODIMENT

Figure 1:
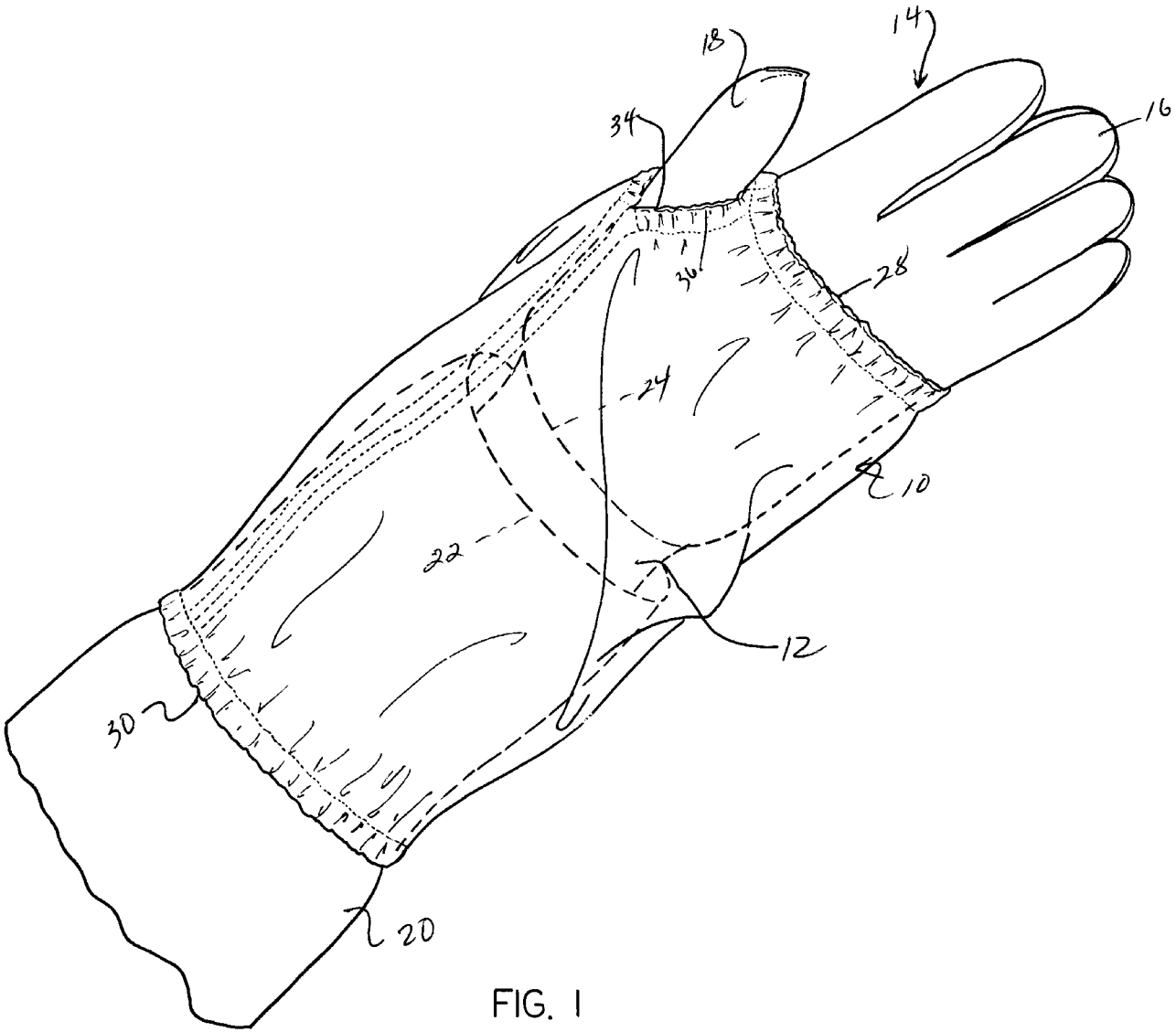
FIG. 1 is a perspective view illustrating the wrist cover of this invention being used by a person.

In the drawings, the numeral 10 refers generally to the wrist cover of this invention. The numeral 12 refers to the wrist of a person while the numeral 14 refers to a glove positioned on the user's hand with the glove including fingers 16 and a thumb 18. The numeral 20 refers to the sleeve of a coat or sweater worn by the person with the lower end 22 of the sleeve 20 being illustrated in FIG. 1.

If the person wearing the glove 14 is working or playing in snowy conditions, the wrist area 12 would normally be exposed and snow can travel upwardly inside the sleeve 20. Even if the upper end 24 of the glove 14 should terminate above the lower end 22 of the sleeve 20, snow can still come into contact with the wrist 12 by means of the open upper end of the glove 14.

The wrist cover of this invention is formed of a generally tubular member 26 having a forward end 28 and a rearward end 30. The tubular member 26 is comprised of a generally rectangular member which is joined together by means of stitching 32 or the like to form the tubular shape illustrated in FIG. 2. The forward and rearward ends 28 and 30 of tubular member 26 are elasticized by any convenient means so that the forward end 28 will be closely positioned around the wearer's hand, as illustrated in FIG. 1, and so that the rearward end 30 will be closely positioned around the sleeve 20 above lower end 22 of sleeve 20.

Figure 2:
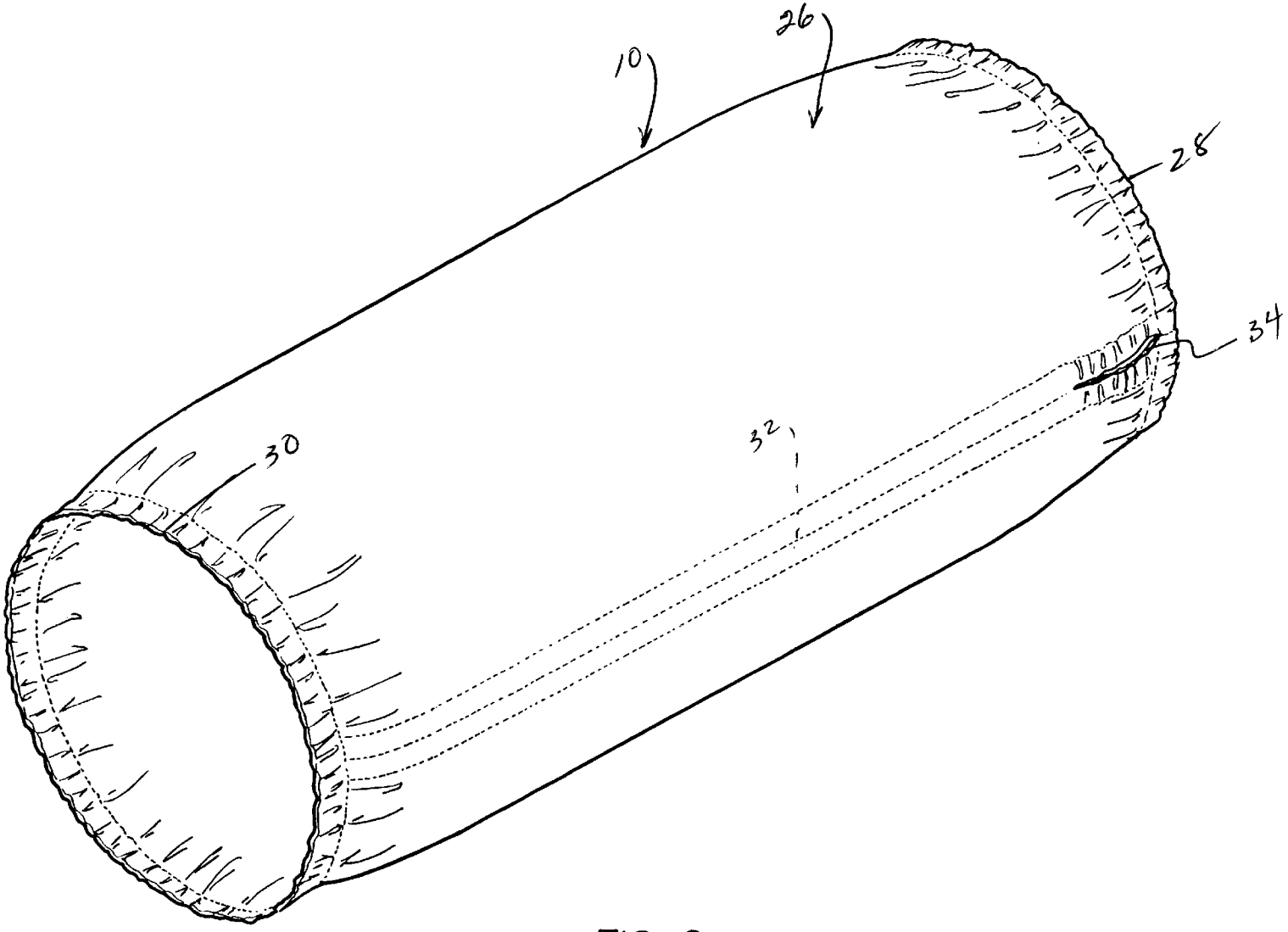
FIG. 2 is a perspective view of the wrist cover of this invention.

An aperture 34 is formed in the tubular member 26 adjacent forward end 28 by simply interrupting the stitching 32 at a predetermined location to enable the thumb of the user to be extended outwardly therefrom, as illustrated in FIG. 1. Preferably, the tubular member 26 is comprised of a nylon or fleece material or any other suitable material. Preferably, the material is also water-repellent or water-resistant.

FIG. 1 illustrates the wrist cover 10 mounted on a person's hand and arm so that the wrist area 12 is enclosed. The elasticized forward end 28 of the wrist cover 10 prevents snow from passing upwardly through the forward end of the wrist cover 10. The elasticized rearward end 30 of the wrist cover 10 prevents snow from passing downwardly into the wrist cover. The fact that the fingers and thumb of the user protrude from the forward end of the wrist cover 10 enables the wearer to have full use of his/her fingers and thumb. The protrusion of the thumb of the wearer through the aperture 34 rearwardly of the forward end 28 limits the amount of rearward movement of the wrist cover 10 with respect to the user's hand. The tubular member 26 is elasticized around the aperture 34 at 36 to prevent snow from entering the interior of the wrist cover around the thumb.

The wrist cover 10 of this invention is quickly and easily positioned on the user's arm and quickly and easily removed therefrom. The wrist cover may be conveniently folded or rolled when not in use so that it may be conveniently stored.

Thus, it can be seen that the invention accomplishes at least all of its stated objectives.

I claim:

1. A wrist cover for covering the wrist of a user wearing a coat having sleeves and a hand covering having a thumb, comprising:

a flexible, generally tubular member having a central portion and forward and rearward ends, said central portion adapted to be positioned loosely over a portion of the user's hand coverings wrist and lower sleeve area;

said forward and rearward ends of said tubular member being elasticized;

said tubular member having an aperture formed therein adjacent said forward end of said tubular member adapted to permit the user's thumb to extend outwardly therethrough;

said tubular member being elasticized around said aperture.

2. The wrist cover of claim 1 wherein said tubular member is formed of a nylon material.

3. The wrist cover of claim 1 wherein said tubular member is formed of a fleece material.

4. The wrist cover of claim 1 wherein said tubular member is comprised of a water-resistant material.

5. The wrist cover of claim 1 wherein said aperture comprises a longitudinal slit.

6. The wrist cover of claim 1 wherein said wrist cover has a longitudinally extending seam extending between its forward and rearward ends and wherein said aperture is created in said seam.

* * * * *